United States Patent [19]

Fischer

[11] 4,437,402

[45] Mar. 20, 1984

[54] ROTARY PRINTING MACHINE SYSTEM WITH OPTIONAL CONTINUOUS WEB PRINTING

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 369,883

[22] Filed: Apr. 19, 1982

[30] Foreign Application Priority Data

May 5, 1981 [DE] Fed. Rep. of Germany ..... 3117663

[51] Int. Cl.[3] ..... B41F 5/16

[52] U.S. Cl. ..... 101/181; 101/228

[58] Field of Search ..... 101/180, 181, 219–221, 101/248, 249, 228, 232, 226, 227, 229, 230, 224; 226/108–111, 118, 119, 178

[56] References Cited

U.S. PATENT DOCUMENTS

| | | | |
|---|---|---|---|
| 2,105,185 | 1/1938 | Degnan | 101/181 |
| 2,863,387 | 12/1958 | Huffman | 101/181 X |
| 3,025,791 | 3/1962 | Averbacher | 101/181 |
| 3,068,787 | 12/1962 | Dall'Oglio et al. | 101/181 |
| 3,218,969 | 11/1965 | Nagel | 101/248 X |
| 3,329,087 | 7/1967 | Sandor et al. | 101/181 |
| 3,561,654 | 2/1971 | Greiner | 101/181 |
| 3,641,933 | 2/1972 | Tafel | 101/181 |
| 3,737,089 | 6/1973 | Slavic | 101/181 |
| 3,963,902 | 6/1976 | Dowd | 101/181 X |
| 4,011,975 | 3/1977 | Brown, Jr. | 226/109 |
| 4,109,843 | 8/1978 | Usui et al. | 226/109 |
| 4,129,238 | 12/1978 | Herd | 101/181 X |
| 4,147,104 | 4/1979 | Zernov et al. | 101/181 |
| 4,214,524 | 7/1980 | Corse | 101/181 |
| 4,240,346 | 12/1980 | Landis et al. | 101/181 X |
| 4,367,832 | 1/1983 | Fabian et al. | 226/118 |

FOREIGN PATENT DOCUMENTS 2753433 5/1979 Fed. Rep. of Germany ..... 101/181

*Primary Examiner*—S. H. Eickholt

*Attorney, Agent, or Firm*—Frishauf, Holtz, Goodman & Woodward

[57] ABSTRACT

To permit, selectively, continuous printing, for example for wallpaper, wrapping or gift wrap paper, plastic or other foils continuously coated wth adhesive or the like, while additionally permitting use of the machine for printing on substrates, such as paper, which have margins, the plate cylinders, or the web between the plate cylinders can be respectively so aligned or offset with respect to each other that the position of a groove (5, 6) on one plate cylinder, which would result in an unprinted strip of paper, can have printing information, or adhesive or the like applied thereto by a plate on another printing station or, selectively, the other printing station may have its plate adjusted to provide printing information in a second color over the printed information applied by the first plate cylinder. The system can be expanded with multiple cylinders, and may be applied to offset, direct lithographic, raised letter, flexo graphic printing, and the like. For continuous printing, two printing cylinders, preferably adjacent printing cylinder will have the same color ink applied thereto, overlap or adjustment being possible to thereby provide, for example, striped patterns of greater color intensity; multiple printing stations can apply patterns of different colors. The relative adjustment of the printing cylinders can be by way of a clutch (FIGS. 5, 6) or by adjustment of the length of the travel of the web between adjacent printing stations, by web length or register control rollers.

14 Claims, 9 Drawing Figures

Fig. 1
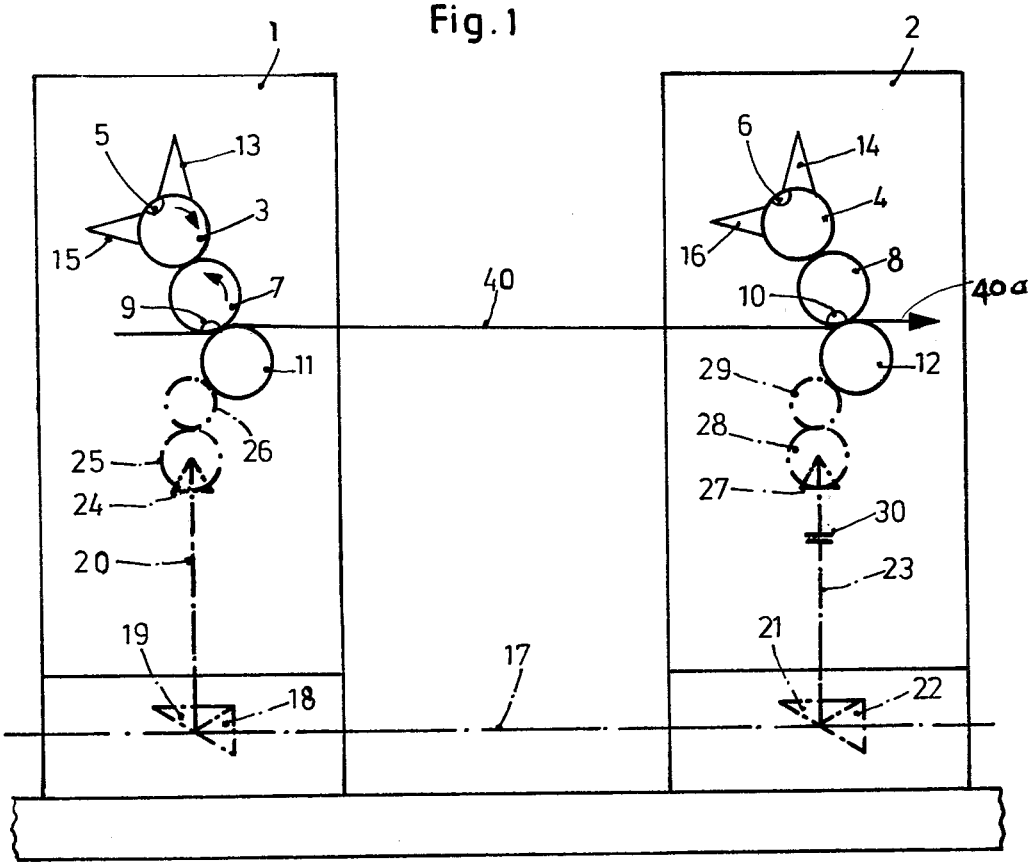
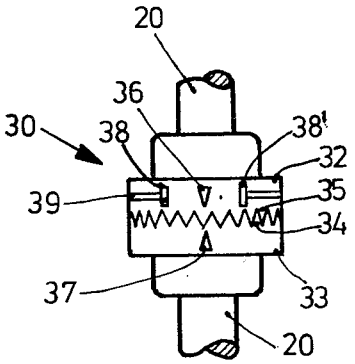
Fig. 2

ROTARY PRINTING MACHINE SYSTEM WITH OPTIONAL CONTINUOUS WEB PRINTING

The present invention relates to a rotary printing machine system having at least one, and preferably more than one, printing station, in which each printing station has plate cylinders and associated inkers, and the plate cylinders are formed with axial grooves to receive printing plates there.

BACKGROUND

Printing machines of the type to which the present invention relates are known, for example see German Patent No. 407369. The machine there described permits essentially continuous printing on a substrate or web of paper or the like. To print with a single color, two partial printing stations are provided which cooperate with a common impression or printing cylinder. The partial printing stations each have a plate cylinder, with a respectively associated inker. For offset printing, each plate cylinder has an associated blanket cylinder and a damper. The plate on the plate cylinder extends over half the circumference of the plate cylinder, and the plates are so arranged that the beginning of the printing line on the substrate of one plate cylinder precisely matches the end of the printed image of the other plate cylinder. Thus, by passing a substrate web under the plate cylinders, the substrate web can be printing continuously without intervening margins.

The printing machine requires, for printing of one color, two plate cylinders and two inkers. If this machine is to be operated under ordinary customary printing conditions, for example to print a book, advertising material, or the like, that is, printed material which has margins, the same color ink must be used with the partial printing station. The interruption of printing by the attachment grooves of the plates is not bothersome when printing books, advertising material, or other material intended for reading, pictorial representation or manual handling since the margin is usually provided anyway. The image to be printed with one color, in the machine, then is copied on two plates, one on each of the partial printing stations, which then must be accurately and precisely positioned relative to each other to maintain proper alignment and register.

THE INVENTION

It is an object to provide a printing machine system which, selectively, permits printing in continuous mode by use of two plate cylinders in which each one of the plate cylinders carries a portion of the material to be printed, to apply printed subject matter of a single color; or, for generally accepted printing, for example books, hereinafter referred to as normal printing, to permit dual color printing by use of the two plate cylinders.

Briefly, the machine is so arranged that the circumferential register of the plate cylinders can be changed between the first position in which the beginning of the printing of an adjacent printing cylinder is in registration; and the second position in which the beginning of printing of the second plate cylinder is shifted by at least the width of the grooves of the plate cylinders.

The system permits, alternatively, essentially normal printing with high utilization of already existing plate cylinders and inkers. Each plate cylinder can print with a color, filling the entire format. The system has the advantage that the set-up time is short since, for any color, only one plate must be placed in accurate registration with respect to another one.

DRAWINGS

FIG. 1 is a schematic side view of a printing machine system;

FIG. 2 is a fragmentary detailed view of a clutch arrangement illustrated in FIG. 1, to a greatly enlarged scale;

Figure 3:
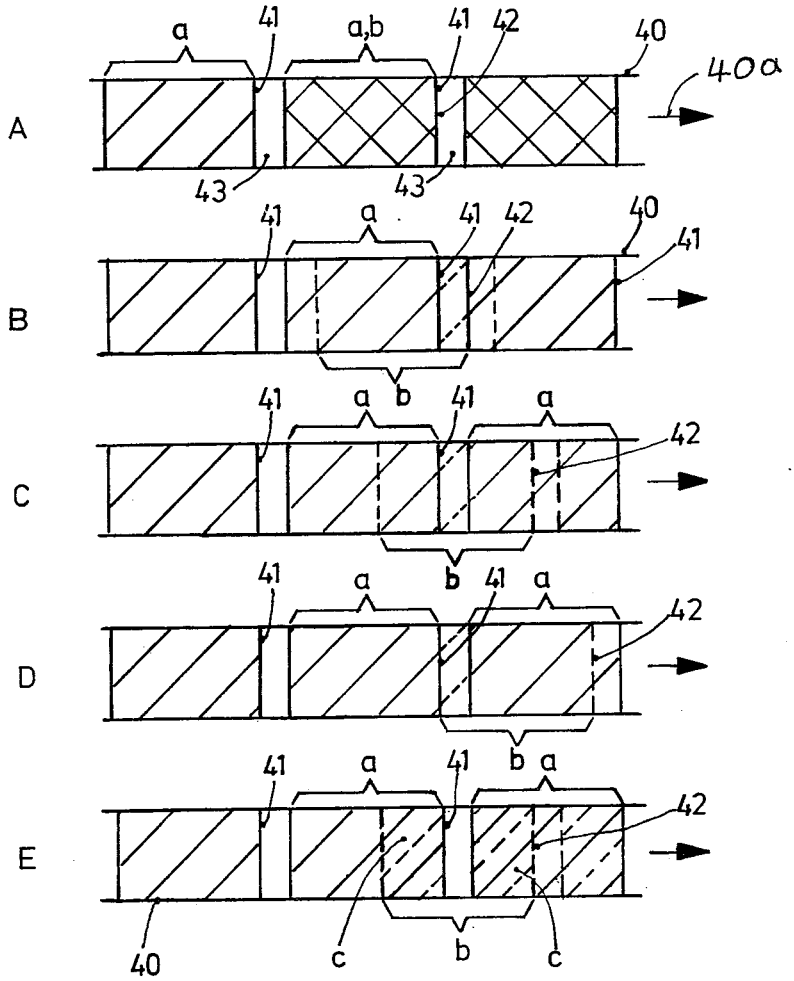
FIG. 3 is a diagram of printing arrangements using the system of FIG. 1.

The printing machine system of FIG. 1 has two printing stations 1, 2. Each printing station is arranged for offset printing and has a plate cylinder 3, 4 formed with a groove 5, 6 therein to receive a printing plate on the plate cylinder and provide for tight, stretched engagement over the plate cylinder. The printing stations, further, have blanket cylinders 7, 8, each formed with a groove 9, 10 therein parallel to the axis of rotation of the respective cylinder to stretch a rubber blanket over the respective blanket cylinder. The printing stations further include impression or printing cylinders 11, 12. Each one of the plate cylinders 3, 4 has an inker 13, 14 associated therewith, and a damper 15, 16.

The printing stations are driven from a main driveshaft 17, which is connected by bevel gears 18, 19 to a driveshaft 20 for the first printing station 1, and over bevel gears 21, 22 to a driveshaft 23 for the printing station 2. The upper end of the driveshaft 20 is connected to a bevel gear 24 which meshes with a bevel gear 25, which, in turn, meshes with a pinion 26, driving the impression cylinder 11. The gearing on the impression cylinder 11, and on the remaining cylinders of the printing station 1 is not shown, since it can be in accordance with any standard construction. The gearing of impression cylinder 11 drives the blanket cylinder 7, plate cylinder 3, as well as all the driven rollers of the inker 13 and the damper 15.

The driveshaft 23, connected to the printing station 2, is connected to a bevel gear 27, meshing with a suitable bevel side gear 28 which, in turn, meshes with a pinion 29 to drive the impression cylinder 12, and hence blanket cylinder 10 and plate cylinder 4, similar to the drive of station 1. The gearing of the impression cylinder, blanket and plate cylinder, as well as of the inker and damper 14, 16 is not shown for simplicity in the drawing.

The driveshaft 23 is interrupted and has a clutch 30 interposed therein. The clutch 30—see FIG. 2—has two coupling halves 32, 33. The facing surfaces of the coupling halves 32, 33 are formed with teeth, or gearings 33, 35. The teeth of the wheels 34, 35 are so arranged that the register connection between the coupling halves of the clutch can be changed. The halves 32, 33 include markers 36, 38, 38' on the clutch part 32, and marker 37 on the clutch part 33. The adjustment can be so made that marker 37 matches the marker 36 or is out-of-alignment therewith, for example, up to limit or terminal positions defined by the markers 38, 38'. A continuously variable, stepless register control arrangement may also be used.

Operation, with reference to FIG. 3: Let it be assumed that the clutch 30 is so adjusted that the markers 36, 37 are in alignment, and that printing is to be effected on a substrate 40. As the web passes in the direction of the arrow 40*a*, through the printing stations, plate cylinder 3 of station 1 will apply a first printed image on the substrate. The beginning of printing is defined by a line 41—see FIG. 3 representing A—and having a length of printed subject matter a. As the web 40 passes through the printing station 2, plate cylinder 4 provides a second impression image having a starting printing line 42 and a length b. The initial lines 41, 42 are congruent. Unprinted or margin regions 43 will remain the printed subject matter. This arrangement is the setup for ordinary printing. Plate cylinder may, for example, supply printed information of a first color, and plate cylinder printed information of a second color, both of the informations being applied to the substrate 40.

Upon disengagement of the clutch 30, and change of the marker 37 to fit against one terminal marker 38, the web 40 will receive a printing image from the first printing station 1 with the start line 41—see representation B of FIG. 3. The start line 42 from the plate cylinder 4, however, is shifted by the width of the unprinted section 43 (representation A of FIG. 3). The shift corresponds to the width of the grooves 5, 9 in the cylinders 3, 7 parallel to their axes of rotation. The plate on the plate cylinder 4 can be so made that it prints only over the length of the portion 43. If it receives the same color ink from the inker 14 as that over the inker 13, a continuous single-color print will appear on the substrate 40, as seen in the representation B of FIG. 3. The portion of the maximum possible length b of the image extending beyond the length of the portion 43 is not used for printing. The representation C and D of FIG. 3 clearly show that the theoretical beginning of the printing line 42 of the printing plate of plate cylinder 4 can be offset by a greater distance than the width of the portion 43, at the most, however, over the maximum possible length b of the printed representation from the plate cylinder 4, less the width of the section 43, that is, the width of the groove. The result, then, will be a continuous uniform print with one color ink in which the region to be printed is shifted on the plate of plate cylinder 4 towards the middle or towards the end portion of that plate. The theoretically possible length of the image representations from the two plate cylinders 3, 4 are again indicated at a and b. The subdivision of the length of the actually printing regions of the plates of the two plate cylinders 3, 4 can also be arranged differently.

The system also permits a variation in which the two printed images overlap, as seen in the representation E of FIG. 3. This arrangement has the advantage that the same color, in different areas of the substrate 40, will have different intensity thereon. This arises by the overlap of printing by the two plates on the plate cylinders 3, 4 which then are used throughout their full length. The sections c will result in which the same color ink is twice applied to the substrate 40.

Figure 4:
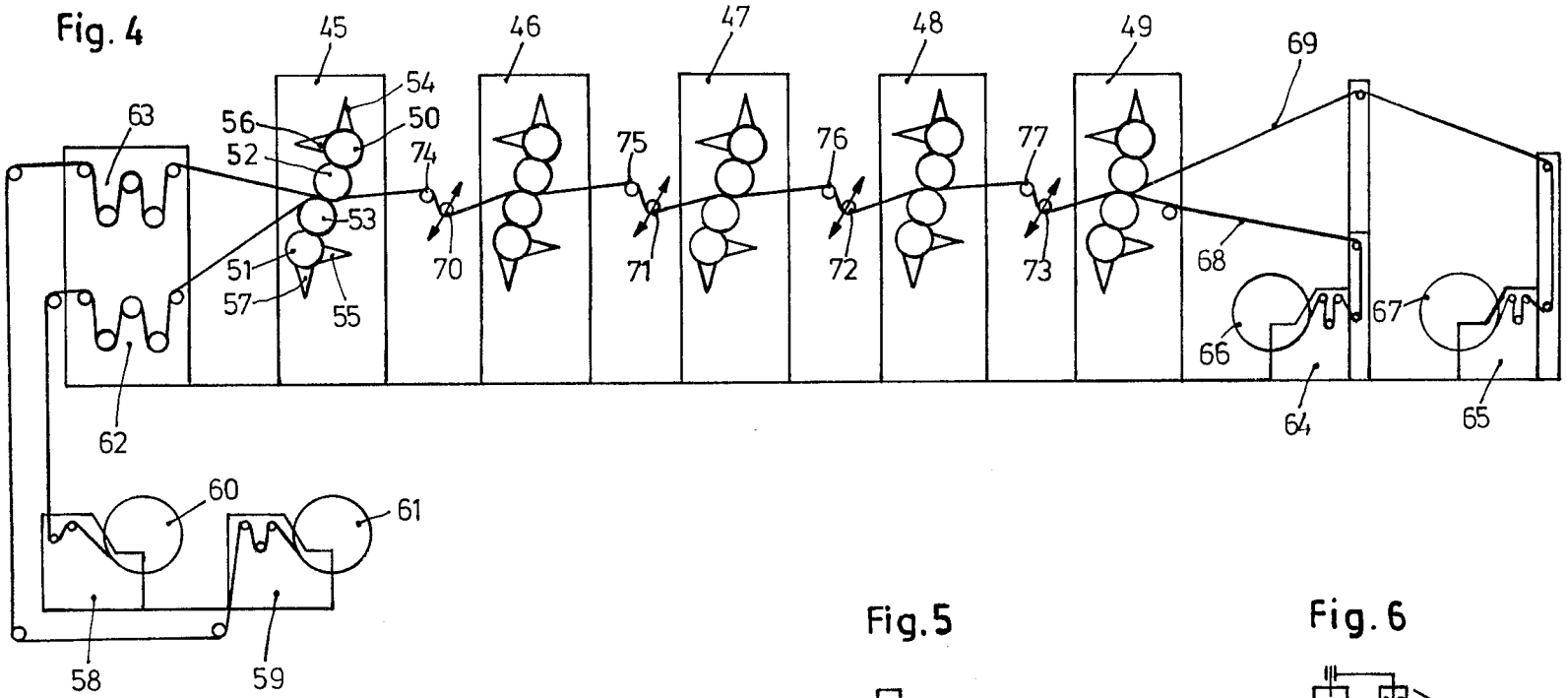
FIG. 4 is a side view of another embodiment of the invention.

FIG. 4 illustrates a rotary offset printing machine for prime and verso printing having fire printing stations 45, 46, 47, 48, 49. Each printing station has two plate cylinders 50, 51, two blanket cylinders 52, 53, two inkers 54, 55, and two dampers 56, 57. Two supply arrangements are provided to supply two printing webs, one supply arrangement 58 supplying a printed paper web from a roll 60, and another, arrangement 59 from a roll 61. The two rolls 60, 61 provide two webs to the input stations 62, 63. The webs are reeled on separate take-up reels 66, 67 in take-up stations 64, 65. The webs are shown at 68, 69 respectively.

The webs 68, 69 are guided between the respective printing stations 45–49 about register control rollers 70, 71, 72, 73. The control rollers 70–73 are pivotally secured to pivot about fixed deflection rollers 74, 75, 76, 77. The register control rollers 70–73 may, in the first position, be so arranged that the beginning printing lines of the plate cylinders of two neighboring printing stations are in registration. The register control rollers can be changed, smoothly and continuously and without steps, or in steps, to a second control position in which the beginning lines of printing from the plate cylinders of two neighboring printing stations are offset with respect to each other by at least the width of the grooves of the plate cylinders of the adjacent printing stations—see FIG. 3, and in the same manner as previously explained in connection therewith.

If only one supply roll 60 is used, and the web 68 is transported to roller 66 through the machine, normal prime and verso printing can be carried out with five different printing colors. Such a mode of operation can be used, for example, to manufacture books having colored pictures therein. If, however, the length of the web 68 passing between adjacent or neighboring printing stations is changed, for example, between stations 45, 46 by tilting or pivoting the register control rollers 70 such that the beginning of the printing lines of the image derived from the plate cylinder of the printing station 46 is offset with respect to the beginning of the printing line from plate cylinder 50 by at least the width of the grooves in the cylinders, then the web may be printed continuously to manufacture, for example, wrapping paper, gift wrapping paper or the like, for printing on both sides, continuously, with one color if the inkers of the two plates of the printing stations 45, 46 have the same color ink applied thereto. The following printing stations 47, 48, 49 can then apply further patterns in three further colors. Of course, the continuously printed ink can also be provided or printed on in other printing stations, for example the printing stations 48, 49 after application of a pattern to the paper.

The possibility to carry two paper webs 68, 69 through the machine permits, as illustrated in FIG. 4, simultaneous printing on the two webs 68, 69 on one side only, that is, prime printing on the two webs. This is of particular importance when, for example, wallpaper or only single-printed gift wrapping paper or the like is to be made. In this mode of operation, the initial print lines of the plate cylinders of the printing station 46 are offset with respect to those of printing station 45 and the initial print lines of the plate cylinders of the print station 48 are offset with respect to the printing station 47, printing on both of the webs 68, 69, each with two colors, to permit continuous uninterrupted two-color printing. The printing station 49 can then, additionally, print a pattern in a third color on the webs 68, 69. The versatility of this arrangement is apparent; or course, the possibility obtains to permit on any one of the webs 68, 69 only with a single color in an uninterrupted pattern. Three further printing stations are then available to print different interrupted patterns with three different additional colors.

Figure 6:
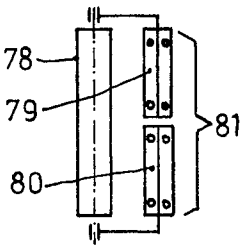
FIG. 6 is a top view of the register roller of FIG. 5.
Figure 5:
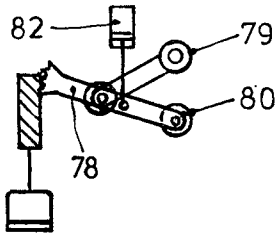
FIG. 5 is a detailed side view of a register roller.

The machine can readily be used to print wallpaper or the like. Wallpaper, generally, is comparatively narrow, for example about 45 cm (or 18 inches nominal). Deflection rollers 78 may thus be used which are illustrated in FIGS. 5 and 6 in greater detail. The deflection roller 78 cooperates with a register control roller 81 which is subdivided into two halves or components or portions 79, 80—see FIG. 6. This arrangement then permits a mode of operation in which two web rollers can be located axially adjacent each other, for example on the carrier 59, and printing on one of the webs continuously in a single color which may form a base color and in three subsequent printing stations three-color patterns; the other one of the webs can receive a continuous two-color impression, with a single-color pattern applied thereto. Each one of the portions or sections 79, 80 of the register control rollers is associated with its own individual positioning element 82 (FIG. 5), for example, a cylinder-piston arrangement, an electric motor driving a worm gear, or the like, in order to control the respective register positions, merely indicated by double arrows in FIG. 4. The actual register positions have been explained in connection with FIG. 3.

Figure 7:
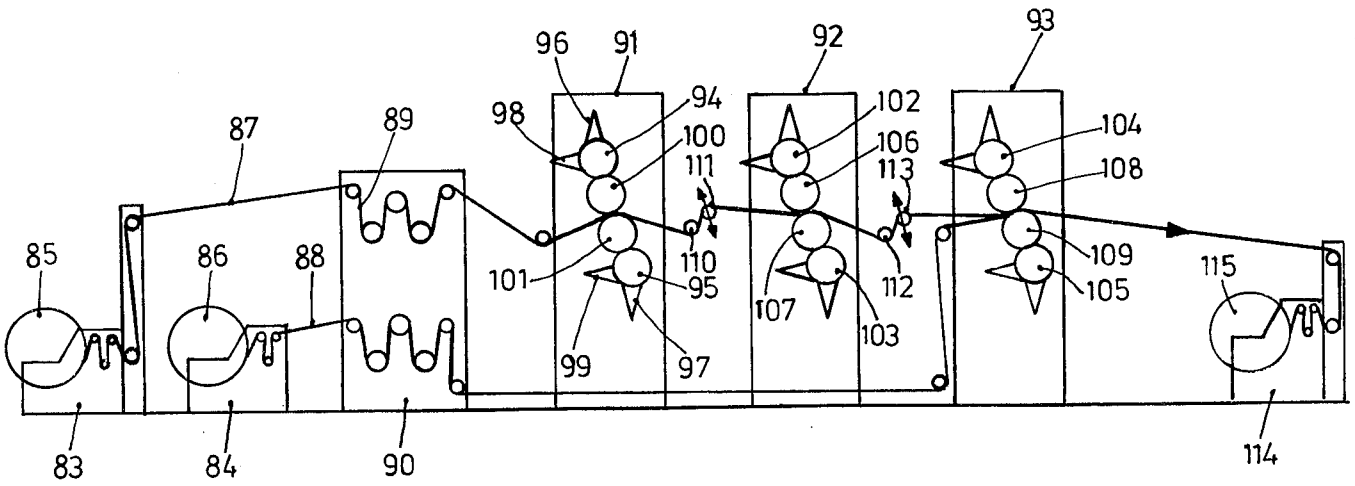
FIGS. 7, 8, 9 are, respectively, side views of further embodiments of the invention, applied to different types of printing machines with different types of roller combinations and arrangements.

The printing machine of FIG. 7 has two supply rollers 85, 86, each carried by a respective roller carrier or roller bed 83, 84 for respective printing web paths 87, 88. The printing webs are pulled through a supply station having respective portions 89, 90 for connection to respective printing stations 91, 92, 93. Printing station 91 has two plate cylinders 94, 95, each having a respectively associated inker 96, 97, and a damper 98, 99. Blanket cylinders 100, 101 are in contact with the plate cylinders 94, 95. The printing stations 92, 93 are constructed similarly to the printing station 91, and each includes two plate cylinders 102, 103; 104, 105; and two blanket cylinders each 106, 107; 108, 109; a deflection roller 110 and a pivotable register control roller 111 are located between the printing stations 92, 93; similarly, a deflection roller 112 and a pivotable register control roller 113 are positioned between printing stations 92, 93. Delivery or web receiving arrangements are provided to receive the printed carrier webs, including a roll carrier 114 in which both webs are rolled on a single roller 115.

The machine of FIG. 7 provides a plurality of possible modes of operation. For example, web 87 may have a three-color prime and verso print applied thereto. The register control rollers 111, 113 are so adjusted that the initial printing lines for the plates of all plate cylinders 94, 102, 104 and 95, 103, 105 all coincide when the web 87 passes therethrough. Further, the machine can be arranged, upon adjustment of the register control rollers 111, 113 to print on the web 87 with a single color, for example by means of the cylinders 94, 102 and 95, 103, thus providing single-color prime and verso printing. Printing station 93 then can apply a pattern in a further color.

The path of the web of FIG. 7 in the machine there illustrated provides the further possibility to print on the web 87 in two stations 91, 92 on the prime side in a continuous mode with a single color, while utilizing the dampers associated with the plate cylinders 95 and 103 to to apply a continuous layer of adhesive. The register control roller 111 then must be so adjusted that the printing plate of the printing cylinder 102 prints that portion of the web which has been left blank due to the presence of the attachment groove on the printing cylinder 94. The web 88 is then applied beneath the printing station 91, 92 and guided directly to fit against the verso side of the web 87 immediately in advance of the nip between the blanket cylinders 108, 109 of printing station 93. The printing station 93 can apply on the prime side a pattern in a second color whereas the lower, or verso, side of the web 88 can have a print applied with a single color. Such an arrangement may be used, for example, to print on adhesive foils, for example on self-adhesive webs which have an adhesive layer on one side, covered by a protective stripping-off layer and which have a pattern, for example a cutting pattern applied thereto. The adhesive should be continuous; the pattern can be discontinued, for example a grid pattern with a recurring interruption.

Of course, further printing stations may be used if it is desired to apply more than two colors to the prime side of the adhesive foil. In such a case, additional printing stations are placed between the inlet side 89 and the printing station 91. If the printing station 88, that is, the protective or adhesive cover foil, should be printed in various colors or continuously, then the additional printing stations should be placed between the printing station 93 and the receiving or take-off station 114 on which the receiving roll 115 is placed.

Figure 8:
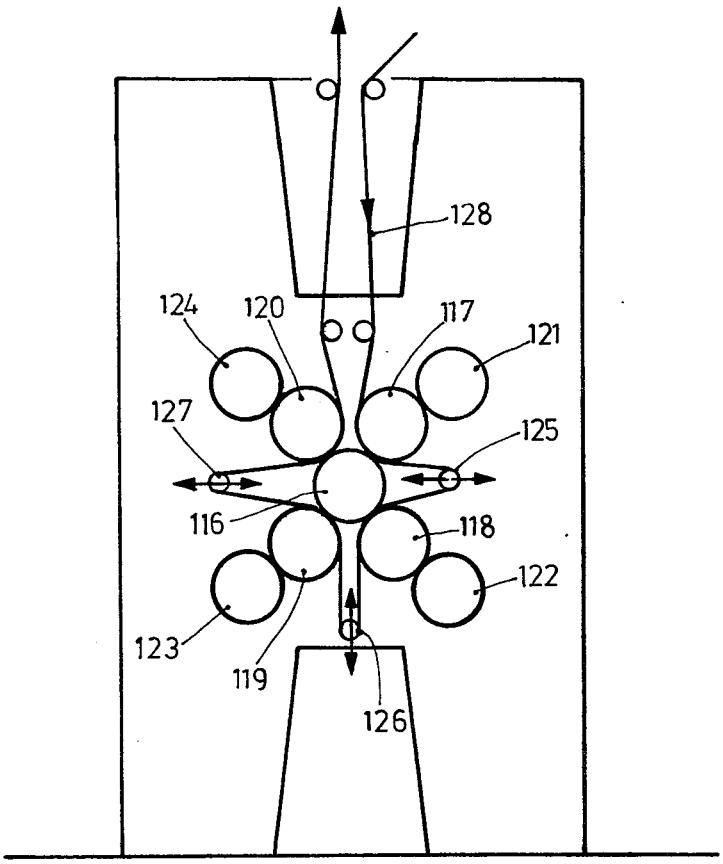

The present invention is applicable not only to linear multi-station systems but also to different types of printing arrangements. FIG. 8 illustrates application of the present invention to a nine-cylinder printing system. The printing system has a central impression cylinder 116, about which four blanket cylinders 117 to 120 are arranged which, in turn, are in surface contact with plate cylinders 121 to 124. The plate cylinders have inkers and dampers associated therewith, not further shown, and as well known which may be of any standard construction. Register control rollers 125, 126, 127 are located between the printing systems formed by a plate cylinder and a blanket cylinder. Each register control roller may be shifted, for example along a straight line, and transverse to the impression cylinder 116. The register control roller 125 can be controlled to assume a first position in which the web 128 passing through the passing stations is so extended that the initial printing lines of the plates of the plate cylinders 121, 122 will coincide. The register control roller 125, additionally, can be placed in a second position in which the plate of the plate cylinder 122 then can be used to print the remaining strip left blank by the plate of the plate cylinder 121, for example with the same color as that applied to the plate cylinder 121, so that the continuous single-color printing is obtained.

Similar adjustment possibilities are provided for the register control rollers 126, 127. Other ways of guiding the printing web 128 in the machine may be used and, for example, a fourth register control roller may be placed between the plate cylinders 121 and 124.

In operation, guidance of the web 128 will provide a continuous print by means of the plates of the plate cylinder 121 in a first color. Thereafter, the plate cylinders 123, 124 can apply patterns in a second and third color on the web 128.

Figure 9:
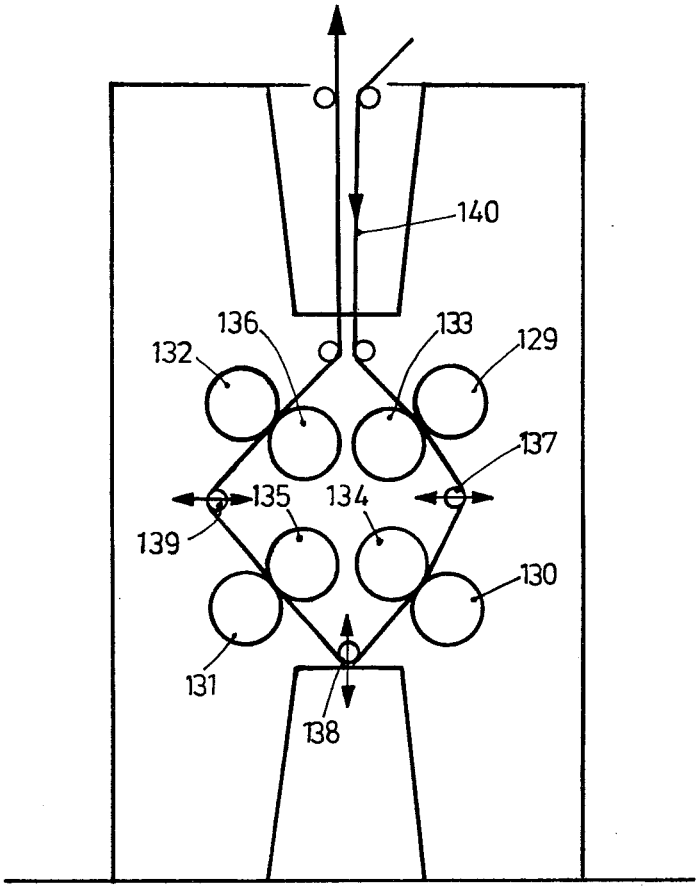

The system can also be used with raised letter printing stations. FIG. 9 illustrates the application of the invention to a eight-cylinder raised letter printing unit. Four plate cylinders 129 to 131, 132 are provided, each having an associated inker (not shown) connected thereto, as well known. Each one of the plate cylinders operates with an impression cylinder 133, 134, 135, 136.

Three register control rollers 137, 138, 139 are provided, which can be adjusted in respective positions, as indicated by the double hyphen arrows, in straight lines, to provide for additional spacing and extension of the path of the web between the respective cylinders. The register control roller 137, for example, is so adjusted that upon printing with the plate cylinder 129, the space left blank due to the groove in the plate cylinder is then printed-on by the plate cylinder 130; register rollers 138, 139 are respectively so adjusted that an additional color ink, each, can be printed by the cylinders 131, 132.

Other ways of guiding the path of the web may be used also in this printing arrangement, for example by including further register control rollers between the plate cylinders 129 and 132.

Various changes and modifications may be made within the scope of the inventive concept. The invention is not limited to the examples described, for instance the arrangement of FIG. 9 may be used also with flexo printing, or can be carried out by use of direct lithographic printing, that is, without an offset blanket cylinder and rather using only a single lithographic plate cylinder, which also has a damper associated therewith applies the printed subject matter directly on the paper web. The impression cylinders 133–136, likewise, may operate in the flexo printing or DiLitho printing mode.

I claim:

1. Rotary web printing machine system, for printing on a substrate web (40) having first and second plate cylinders (3, 4; 50; 51; 94–102–104; 95–103–105; 121–124; 129–132), in which the second plate cylinder is located downstream—in the direction of movement of the web through the machine system—of the first plate cylinder, each plate cylinder having a clamping groove (5, 6) parallel to the axis of rotation of the plate cylinder to receive a printing plate thereon, the printing plate in a zone adjacent the groove defining a beginning, or starting printing line (41, 42), printing by the plate on the respective cylinder being interrupted at the groove resulting in gaps of printed subject matter, parallel to the axis of rotation of the plate cylinder, and being printed by the respective plate;

an inker (13, 14; 54, 55; 96, 97) associated with each cylinder to provide ink thereto;

said system comprising means for selectively printing on a substrate either continuously, e.g. in a single color, or in two colors with a gap, or interruption in the region of the groove for at least the width of the groove defining said gap comprising means (30; 70–73; 81; 111, 113; 125–127; 137–139) for selectively locating the circumferential position of the first and second printing cylinders with respect to the web to place, selectively, (a), for printing continuous subject matter without a gap, the printing line (41) defined by the plate on the first cylinder and the printing line (42) defined by the plate on the second cylinder at longitudinally shifted locations by at least the distance of the width of the gap (43) between succeeding printing lines (41) defined by the plate on the first cylinder to effect, in mode (a) continous printing of subject matter on the web (40) without interruption of subject matter due to the presence of the clamping groove; or (b), to permit multi-color printing with unprinted gaps on the substrate web (40), the printing line (41) defined by the plate on the first cylinder and the printing line (42) defined by the plate on the second cylinder in registration to effect printing in mode (b) by the two printing cylinders with a gap (43) of printed subject matter on the web at the location of the clamping groove.

2. System according to claim 1, wherein the selective position locating means are adjustable between limit positions which are defined by offset, or shift of the beginning or starting printing lines of two adjacent plate cylinders corresponding to the length or the printing information capable of being printed from a plate less the width of the clamping groove.

3. System according to claim 1, where the selective position locating means comprises a continuously variable, stepless register control arrangement.

4. System according to claim 1, wherein, for raised letter, flexo printing, or DiLitho printing, an impression cylinder (133–136) is provided, associated with each plate cylinder (129–132).

5. System according to claim 1, wherein, for offset printing, a rubber blanket cylinder (7, 8) and an impression cylinder (11, 12) are provided, associated with each of the plate cylinders and forming a printing sub-system.

6. System according to claim 5, where, for prime and verso printing, the blanket cylinders (52, 53; 100, 101; 106–109) of one printing sub-system form, simultaneously, the impression or printing cylinders of an oppositely positioned printing sub-system, associated with an oppositely positioned plate cylinder (50, 51; 94, 95; 102, 105);

and the substrate carrier web (68, 69; 87, 88) is passed between two opposed rubber blanket cylinders.

7. System according to claim 5, wherein (FIG. 8) each plate cylinder (121–124) has a blanket cylinder (117–120) associated therewith;

and a common impression cylinder (116) is provided, centrally positioned between the blanket cylinder and wherein the selective position locating means (125–127) comprises means positioned between the first and second plate cylinders for changing the length of the path of the substrate carrier web on which printing is to be effected.

8. System according to claim 7, wherein the selective position locating means comprises register control rollers (125–127), the carrier web substrate (128) being looped about the control rollers and lifting the carrier web substrate off the circumference of the impression cylinder in the region between adjacent blanket cylinders.

9. System according to claim 6, including at least two printing stations, the first and second plate cylinders being part of respective printing stations;

means for simultaneous printing, each, on one side of two substrate webs (68, 69; 87, 88) being passed through said printing stations;

and wherein two web supply means (58–60; 83–86) are provided to supply fresh un-printed substrate web to said printing stations;

and at least one receiving station (64, 67; 114, 115) is provided to receive the printed carrier webs.

10. System according to claim 9, wherein (FIG. 7) two cooperating rubber blanket cylinders (100, 101;

106, 107) are provided applying printed information on one side of one carrier web (87), and an adhesive on the other side of the carrier web;

and wherein a further printing station is provided, the second carrier web (88) being applied to the side of the first carrier web having the adhesive thereon in advance of the third station, the third station (93) including two further printing sub-systems (104, 108; 105, 109) providing further printing information on the first web (87) at the first side thereof and additionally printing information on the verso side of the second web (88).

11. System according to claim 1, wherein the first and second printing cylinders are located at first and second printing stations;

a main driveshaft (17) is provided for said printing system, each printing station having an individual station drive shaft (20, 23) in driving relation to said main driveshaft (17) and driving the respective driving stations;

and wherein the selective position locating means comprises a clutch (30) in one (23) of said station driveshafts (20,23), said clutch having clutch elements which can be shifted circumferentially with respect to each other.

12. System according to claim 11, where the clutch elements (32, 33) each carry an opposed tooth face for positive engagement of the clutch elements with respect to each other in predetermined respectively adjustable circumferential positions.

13. System according to claim 1 wherein the first and second printing cylinders are located at first and second printing stations;

the selective position locating means comprises means (70–73; 81; 111, 113; 125–127; 137–139) engageable with the web or substrate (40) on which printing is to be effected, located between said first and second printing stations, and controlling elongation or shortening of the path of the web between the plate cylinders of adjacent printing stations, to effect printing in accordance with either mode (a) or mode (b) by controlling the position of the respective starting printing lines (41, 42) of the respective plates on the respective first and second cylinders to be, selectively, for printing mode (a) congruent; or for printing mode (b), shifted or staggered by at least the width of said gap (43).

14. System according to claim 13 wherein (FIGS. 5, 6) the selective position locating means comprises axially aligned roller means which are subdivided into axial portions 79, 80).

* * * * *